US007012605B1

(12) United States Patent
Manome

(10) Patent No.: US 7,012,605 B1
(45) Date of Patent: Mar. 14, 2006

(54) METHOD FOR GENERATING FONTS FROM VERY SMALL DATA SETS

(75) Inventor: Yoichi Manome, Ibaraki-ken (JP)

(73) Assignee: Hewlett-Packard Development Company, L.P., Houston, TX (US)

( * ) Notice: Subject to any disclaimer, the term of this patent is extended or adjusted under 35 U.S.C. 154(b) by 1447 days.

(21) Appl. No.: 08/968,961

(22) Filed: Nov. 12, 1997

(30) Foreign Application Priority Data

Nov. 11, 1996 (JP) ..... 8-298324

(51) Int. Cl.
*G06T 11/00* (2006.01)

(52) U.S. Cl. ..... 345/469; 345/467

(58) Field of Classification Search ..... 345/467–469, 345/418, 419, 430, 143; 382/187; 364/518
See application file for complete search history.

(56) References Cited

U.S. PATENT DOCUMENTS 4,748,443 A * 5/1988 Uehara et al. ..... 340/751
4,849,907 A * 7/1989 Aotsu et al. ..... 364/518
5,481,277 A * 1/1996 Morinaga ..... 345/143
5,610,996 A * 3/1997 Eller ..... 382/187
5,727,140 A * 3/1998 Ohtomo et al. ..... 345/467

FOREIGN PATENT DOCUMENTS

JP 2-23871 5/1990

OTHER PUBLICATIONS

Adobe Systems Incorporated, "Adobe Type 1 Font Format", Addison-Welsey Publishing Company, 1990, ISBN0-2-1-57044-0, Chapters 1 and 6.
Adobe Systems Incorporated, "PostScript Language Reference Manual (second edition)", Addison-Welsey Publishing Company, 1990, ISBN0-201-18127-4, pp. 278-282.
Adobe Systems Incorporated, "Type Font Format Supplement", May 1994, Technical Specification #5015, pp. 8-26.
Apple Computer, Inc., The True Type Font Format Soecification Version 1.0., 1990, R060ILL/A, pp. 1-39.
Karow, Peter, "Digital Typefaces", Springer Verlag, 1994, ISBN:0-340-56509-4, pp. 57-185.
Karow, Peter, "Font Technology", Springer Verlag, 1994, ISBN:0-340-57223-6, pp. 105-133.

* cited by examiner

*Primary Examiner*—Sumati Lefkowitz
*Assistant Examiner*—Chante Harrison

(57) ABSTRACT

A character that includes a character element is represented and/or displayed by receiving a character element code that specifies the character element and skeleton point data that represent a position of the character element, providing a character element generating function corresponding to the character element code, and generating the shape of the character element using the character element generating function with the skeleton point data as arguments therefor.

3 Claims, 10 Drawing Sheets

METHOD FOR GENERATING FONTS FROM VERY SMALL DATA SETS

FIELD OF THE INVENTION

The present invention relates to a character generation method and particularly to a high-quality character generation method and apparatus which decrease the amount of data used in character generation.

BACKGROUND OF THE INVENTION

There are many requirements to display numbers, symbols or letters (characters) on a display or to print characters. To simplify the following description, the verb display will be understood to include the verb print and the noun display will be understood to include the noun printer. The display displays characters in response to a data set that defines the shape and size of each of the characters displayed. In their crudest form, the data sets are bitmaps composed of a data element for each picture element (pixel) in the area of the display occupied by the character. The data element defines whether the pixel is ON or OFF. Although bitmaps are normally ultimately generated when a character is displayed using a conventional monitor or printer, bitmaps are very inefficient in terms of memory requirements or transmission bandwidth requirements if characters are to be stored or transmitted. Not only is an individual bitmap required for each character in the character set, sets of bitmaps are required for each different font. The word font as used in this disclosure means a character set unified by typeface and size. What is required in modern displays is to be able to display characters in many different fonts without increasing the amount of storage capacity or hardware required, and without increasing the processing time needed to display, transmit, and store the characters.

Methods that represent characters using bitmaps require a large number of data to represent a number of typefaces because of the extreme difficulty in enlarging, reducing, and transforming bitmaps. Others have therefore represented characters in different ways with the goal of reducing the number of data required.

Two processes are involved in representing a character set using fewer data than are required to represent the corresponding bitmaps. A compact data set that represents the character set must be created. The compact data set can then be stored in the device in which it is created or can be transmitted or transferred to another device. To display one or more characters of the character set represented by the compact data set, bitmaps representing the characters are normally generated in response to the compact data set so that the characters can be displayed using a normal pixel-based monitor or printer.

Japanese Examined Patent Publication No. H2-23871 discloses a method for representing and displaying kanji characters. In this method, kanji characters are each divided into left and right radicals or may be divided into top and bottom radicals, depending on the character. The radicals are stored, and selected ones of them are then combined to synthesize kanji characters. However, since the shapes and sizes of the radicals are fixed, this method requires a large number of data to handle many fonts, i.e., many different typefaces in many different sizes. This method requires that a large number of data be stored even when the data stored are static outline data obtained by tracing the fixed radicals.

Moreover, since static outline data include static skeleton point data, all of the radicals change proportionally when the character is scaled, i.e., enlarged or reduced. As a result, scaling the character destroys the harmony between the radicals, particularly the design balance of the line widths. Scaling not only expands each character to cover a wider area when the point size is increased or compresses the character into a narrower area as the point size is decreased, but also introduces an offset between the visual center of the character and the geometrical center. This causes the position of the character in a character string to vary, and reduces the quality of the alignment of characters when groups of characters are arranged in rows and columns such as in a conventional printed document.

Finally, generating static outline data by tracing the radicals still requires a relatively large number of data to represent the character set.

To handle the problem of the distortion of character shape and alignment that occurs when characters are scaled, the character set, the line width of a radical corresponding to the points, the aspect ratio of the line width, and the design are changed and the static outline data are prepared again. However, this further increases the number of data required to represent the character set.

Another method of representing character sets is the outline font, such as the Bitstream™ and Postscript™ fonts. Static outline data are generated from each character by tracing the outline of the character using spline curves or Bezier curves. An example of this is shown in FIG. 1. The character shown in the drawing is specified by data representing the 20 data points 101, each of which is shown in the drawing by a circle (o), and a character generating function that operates in response to these data points. The character generating function generates the character shape 100 by successive approximation. Many data are required to specify the character and, because of the complexity of the calculations required, the rendering speed is slow.

Thus, although outline fonts can be used to generate compact data sets representing character and to display characters in response to such compact data sets, they suffer from the problems described above. The severity of some of the problems can be reduced by using hinting data, which are different for every character. Moreover, outline font data are difficult to modify, so new characters, i.e., characters outside the character set for which outline font data exist, are difficult to create by modifying existing outline font data. New typefaces are also difficult to create by modifying existing outline font data. This means that it is difficult to generate new characters quickly. Consequently, outline fonts are only practical in applications that represent text using fixed character sets so that the need to generate new characters arises only infrequently. This sets a practical limit on the product of the number of characters in the character set and the number of fonts to about 6,000 to 7,000.

What is needed is a method and apparatus to create compact data sets representing character sets and to display characters in different fonts in response to such compact data sets with no degradation in character quality even when the character set and the number of fonts are both large.

What is also needed is a character generation method in which scaling the character does not degrade character quality.

What is also needed is a character display method that can display new characters easily, and that generates compact data sets that represent characters at high speed and in a compact form ideal for character transmission.

Finally, what is needed is method of representing characters that allows the shape of the character to be easily changed.

SUMMARY OF THE INVENTION

The invention provides a method for representing and/or displaying a character that includes a character element. In the method, a character element code that specifies the character element and skeleton point data that represent a position of the character element are received. A character element generating function corresponding to the character element code is provided, and the shape of the character element is generated using the character element generating function with the skeleton point data as arguments therefor.

The invention also provides a method for representing and/or displaying a character that includes a stroke. In the method, a character element code specifying the stroke is recieved. Skeleton point data representing a position of the stroke is then received, after the character element code has been received. Finally, the shape of the stroke is calculated using a character element generation function that corresponds to the character element code with the skeleton point data as arguments for the character element generation function.

The invention further provides an apparatus for displaying and/or representing a character that includes a character element. The apparatus comprises an input device, a memory device, a processor, a rasterizer and a display. The input device is configured to receive a character element code that specifies the character element and skeleton point data that represent a position of the character element. The memory device stores a character element generation function corresponding to the character element code. The processor receives the skeleton point data and the character element generation function and generates a shape of the character element using the character element generation function with the skeleton point data as arguments therefor. The rasterizer generates a bitmap signal in response to the shape of the character element. The display displays the character element in response to the bitmap signal.

Finally, the invention provides a computer-readable storage medium on which is stored a program that instructs a computer to generate a character that includes a character element. The computer generates the character by receiving a character element code that specifies the character element and skeleton point data that represent a position of the character element, calling a character element generation function corresponding to the character element code, and calculating the shape of the character element using the character element generation function with the skeleton point data as arguments therefor.

DETAILED DESCRIPTION OF THE INVENTION

Figure 1:
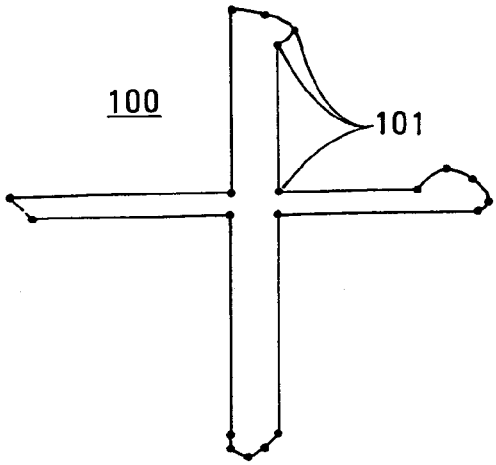
FIG. 1 illustrates how a character is represented using a conventional outline font.

The invention is based on the inventor's discovery that characters that constitute character sets such as fonts can be built from character elements arranged in a hierarchical structure. Although the characters that constitute a character set are all different, many of the characters share common character elements. Moreover, although the character elements from which the characters constituting the character set are built are all different, many of the character elements share common lower-level character elements. For example, in certain fonts, the lower-case Roman letters h, k and l share a common character element, namely, the vertical stroke that constitutes the letter l. Moreover, in certain fonts, the serif at the top of the vertical stroke of the letters b, h, k and l also forms part of the vertical stroke forming part of the letters d, i, j, m, n, p and r.

Therefore, by regarding the characters constituting the character set as respective sets of character elements located in different levels of a hierarchical structure, by providing skeleton points that specify the position and shape of each character element, and by providing character element generation functions that operate in response to the skeleton point data to generate the shapes of the character elements, the character set can be represented using a significantly smaller data set than is conventionally required. The character element generation functions selected are those that generate curves with as few spurious curvature changes as possible.

The character elements forming a character are specified by character element codes. To represent a character, a character element code is provided. The character element code specifies each of the character elements from which the character is built. The character element code is linked to respective skeleton point data that represent the position and shape of each character element. When the character is displayed in response to these data, a character element generation function specified by the character element code operates in response to the skeleton point data to define the shape of the character element.

As will be described in more detail below, although it depends on the way a character element is defined, the character elements of a skeleton character are preferably modeled on the strokes required to write the character by hand. The set of skeleton point data corresponding to a character element is called the skeleton of the character element. The skeleton point data of all of the character elements of a character constitute the skeleton character of the character. If readability and aesthetics are unimportant, the character can be displayed simply using the skeleton character, i.e., the skeleton point data of the character elements of the character. The skeleton character is scaled when the character is displayed with a different size.

The character element generation functions that define the shapes of the character elements from which a character is built are arranged in a hierarchical structure. At the top of the hierarchy is the character itself. Each character element is identified, and is distinguished from all other character elements, by assigning a unique character element code to the character element. However, if the character element constitutes the entire character, the character element code of the character element is also called the character code.

As an example of the hierarchical structure, a character can be built using one or more radicals each defined by a radical function. Each radical can be built using one or more strokes each defined by a stroke function. Each stroke can be built using a stroke beginning defined by a stroke-beginning function, a stroke line defined by a stroke-line function, and a stroke end defined by a stroke-end function. Each character element is specified by identity codes for its constituent character element generation functions and respective skeleton point data that are inserted as the arguments of the character element generation functions. The identity codes of the character element generation functions will be called character element generation function codes.

When a character is displayed in response to a character code, the corresponding character element codes from which the character is built, the character element generation functions corresponding to the character element codes, and the skeleton point data for the character element generation functions are called from storage. The shape of the character is generated by the character element generation functions in the positions determined by their respective arguments, i.e., skeleton point data in the preferred embodiment. The interior of the generated shape may then be filled to generate an ordinary character with solid lines. The character shape thus generated is then subject to a rasterizing operation to generate the bit map for feeding to the display.

In one embodiment of the present invention, each character element generation function is a stroke function. The arguments of the stroke function are skeleton point data defining the position, size and shape of the skeleton of the character element. The stroke function may be composed of at least a stroke-beginning function and a stroke-end function. If needed, the stroke function may additionally be composed of a stroke-line function. The typeface in which the character is displayed is determined by the character element generation functions applied to the skeleton character.

Environment variables may specify the typeface of the font in which the character is displayed. In addition to the environment variables, modification parameters that define modifications to each character element generation function can be given when needed. Changing the environment variables and/or modification parameters changes the character element generation function, which changes the typeface. Moreover, in one embodiment of the invention, the character shape and position are readily changed by applying a conformal transform or an affine transform to the skeleton point data, or by adding or subtracting constants to or from the skeleton point data to provide a spatial transform.

When the characters are to be displayed in a new font that is not already resident in the display and that cannot easily be downloaded into the display, the new font must be created. In this case, the values of the environment variables that define the new font are determined. Alternatively, predetermined values of the environment variables that were previously stored in the display for use in generating the new font are used as will be described in more detail below. The new font may be generated interactively on the screen of a workstation. The skeleton point data of the character elements, the respective character element generation functions, and, when needed, the modification parameters are specified to cause the character elements from which the character is built to be displayed on the screen. After the needed character elements have been displayed, the arguments and character element generation functions of the character element are stored in the memory of the workstation with the character code. If necessary, environment variables and modification parameters can be appended and stored.

The character information created and stored in accordance with the invention may be transmitted to another display in the manner described in a United States patent application entitled Document Display System for Displaying Documents Set in Fonts Not Native to a Display Device Forming Part of the System. The inventor of the patent application is Koji Miyauchi, the patent application was filed on the same day as this application and was assigned to the same assignee. The entire disclosure of Miyauchi's patent application is incorporated into this disclosure by reference.

Figure 2:
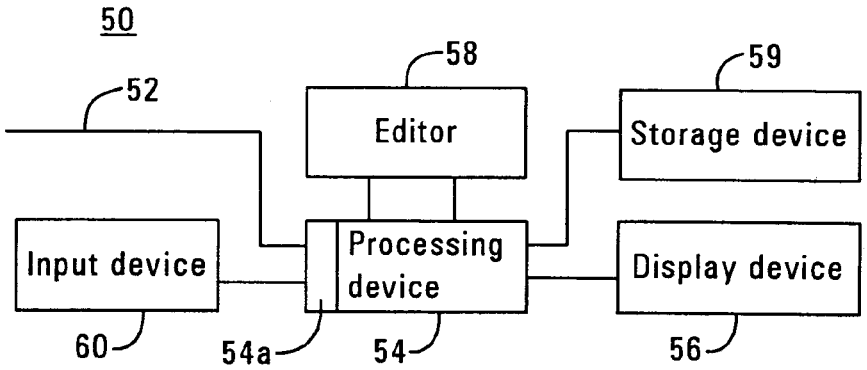
FIG. 2 is a block diagram of a workstation that can be used to perform the method according to the invention.

FIG. 2 is a block diagram of a workstation that operates according to one embodiment of the invention. The invention may alternatively be embodied in a personal computer or a wordprocessor. The workstation is capable of creating compact data sets representing typefaces, fonts or characters, and is also capable of displaying characters in response to received compact data sets and character codes.

In the workstation 50, the processing device 54 includes a microprocessor, digital signal processor, or other signal processing device. The processing device also includes the communication device 54*a* connected to the communication line 52. Additionally or alternatively, the communication device is connected to the input device 60. The input device typically includes a mouse or other pointing device, any may additionally include a keyboard.

Through the communication device 54*a*, the processing device 54 receives character codes Lc each of which uniquely identifies a complete character. Additionally or alternatively, the processing device may receive character element information including character element codes, skeleton point data of the character elements, skeleton characters, modification parameters, etc., and, when needed, environment variables E. Software running on the processing device additionally implements the editor 58 that combines any of the above parameters with the rest of character information to be referred to form a complete data set for a displayable character, creates a bitmap signal representing the displayable character, and feeds the bitmap signal to the display device 56. The display device then displays the character in response to the bitmap signal. Default values stored in the storage device 59 provide data needed for character display without the need to receive such data via the communication device 54*a*.

Operation of the workstation 50 to display characters in response to character codes received via the communication device 54*a* will now be described.

The environment variable E includes the following elements:

weight W that defines the half-width of the vertical lines of the character;

contrast C that defines the ratio between the width of the horizontal line to the width of the vertical line;

kind K that defines the typeface; and size S that indicates the size of the character. The environment variable defines elements that are common to the characters constituting a font.

When a font represented according to the invention is transferred from one device to another, the following data format is adopted. The data transfer includes a header that includes the flag F that identifies the location of the environment variable E. The flag is placed at the head of each line of character codes. Consequently, the character data are transmitted as (header 1) (character code 1) (character code 2) (character code 3) (character code 4) . . . (character code n) (header 2) (character code n+1). . . . Header 1 relates to a first font, header 2 relates to a second font, etc.

Since the environment variable E is often constant and many characters are transmitted, many character codes are successively transmitted after the environment variable. Thus, the header represents a relatively small overhead in the data transfer. In one embodiment of the present invention, the elements F, W, C, K, S, and the character code Lc are represented by 1, 1, 1, 1, 2, 2 bytes, respectively. When six kanji characters are transmitted, each of which is represented by a two-byte character code Lc, the overhead represented by the 8-byte header increases the average bytes per character to 3.6. Normally considerably more than six character codes are transmitted after each header.

When the data transfer is received, the header is decoded to extract the environment variable E, and the skeleton character corresponding to the character code, and the character element generation function codes are determined. For many characters, the character code is parsed into a set of character element codes and corresponding skeleton point data. Each corresponding character element generation function is read from the storage device 59, and the shape of the character are generated. The shape data may remain unchanged or an additional process to fill the shape to produce a solid character may be performed. The resulting shape data are then subject to a rasterizing operation to generate a bitmap signal in response to which the display device 56 displays the character.

As an alternative to receiving the character code Lc from the communication line 52 or the input device 60, the workstation may alternatively receive a set of character element codes defining the character.

When a character is created, the environment variable E, the character element code, and the skeleton point data of the character elements are input using the input device 60 and stored in the storage device 59. The shapes of the character elements are displayed at prescribed positions on the screen of the display device 56. For each of the shapes, the character element generation function based on the character element code and the environment variable are called from the storage device 59 and are modified, and the character element generation functions calculated with the skeleton point data as their arguments are displayed on the screen of the display device 56. This process is repeated for only the number of needed character elements. When the desired characters are displayed on the screen of the display device 56, the character generation process ends.

The amount of data generated to represent each character is quite small. For example, a kanji character composed of 18 strokes can be represented by a total of $(18\times(1+(2\times3)))=126$ bytes. Each of the 18 character elements, i.e., strokes, is represented by a one-byte character element index and an average of six bytes of skeleton point data. The average of six bytes of skeleton point data is composed of two bytes of skeleton point data per skeleton point and an average of three skeleton points per character element. The character element generation function for the character element is defined by the character element index.

If modification parameters are required, they are input using the input device 60, stored in storage device 59 and are used in connection with generating the shapes of the character elements.

Furthermore, by finely adjusting the skeleton point data using the input device, a temporarily created character can be revised and the appearance of the character can be improved. Conventional technology can be used to enable the character elements to be dragged while preserving the shapes in which they are displayed. This enables a character to be modified easily.

A character is created by assigning a character element generation function to each structural element, for example, a structural element equivalent to a stroke, of the skeleton character. As a result, the skeleton character may be stored in the storage device using relatively few data and the character may be created in accordance with the environment variables when the character is needed. This provides a large reduction in the storage capacity required to store a font.

The data set composed of the skeleton point data of all the character elements constituting the character forms the skeleton character. The skeleton character can be called from the storage device and the character can be displayed in response to a simple character element generation function that generates a line interconnecting the skeleton points constituting each skeleton of the character.

The hierarchical structure of the character element generation functions used in the character generation method of the present invention will now be described with reference to FIGS. 3A and 3B. In the hierarchical structure, the level in the structure will be indicated by the variable k (k=0, 1, 2, 3, . . . ), where k=0 is the highest, i.e., character, level.

At the highest level, each character L that is a member of the font is represented by a group composed of the character code Lc and the character element codes $Cc_i$ (i=1, 2, 3, . . . ) of the character elements that form the character L. Each character element code $Cc_i$ specifies the character element generation function $f_j$ and the respective argument $V_j$ (j=1, 2, 3, . . . ). These arguments are the skeleton points constituting the skeleton of the character element. Alternatively, the character element code $Cc_i$ can represent the character element generation function $f_j$ itself In addition, the arguments $V_j$ are linked to each other through the character code Lc and the character element code $Cc_i$ to enable them to generate the character L.

At the lower levels, the character element code $Cck_i$, the character element generation function $fk_j$, and the argument $Vk_j$ belonging to level k (k=0, 1, 2, 3, . . . ) are represented by a group composed of the character element code $Cc(k+1)_i$, the character element generation function $f(k+1)_j$, and the argument $V(k+1)_j$ that define the character elements belonging to the next lower level k+1.

For example, the character element generation function $f_j$ stored in the processing device 50 may be grouped with the argument $V_j$ received via the communication device 52 or the input device 60. The processing device can then generate the shape the respective character element and display that shape using the display device 56.

In an example of the application of the character display method according to the invention in a network environment in which a server and multiple workstations communicate with each other, each workstation stores on its own storage device 59 a set of the character element generation functions $f_j$ required by the terminal to display the characters received from the server. The server stores a large number of characters coded as skeleton characters composed of skeleton point data corresponding to the argument $V_j$. Coding the characters this way enables the characters to be stored in a reduced amount of memory, and enables the characters to be transmitted to the terminals with a reduced transmission bandwidth. The terminal receives the skeleton characters from the server, invokes corresponding character element generation functions $f_j$ stored in its own storage device 59, and displays the respective characters.

Figure 3A:
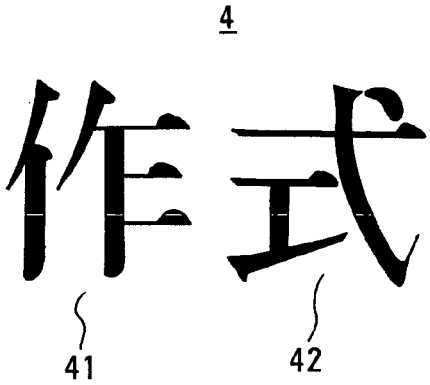
FIG. 3A shows one example of a kanji character handled by the present invention.

The character 4 shown in FIG. 3A is the group "SAKUSHIKI" 4 composed of the kanji characters 41, 42. The way in which a compact data set representing the group "SAKUSHIKI" is generated will now be described with reference to FIG. 3B. The following description is merely an example. The method according to the invention is not limited to generating compact data sets representing kanji characters, but can be used to generate compact data sets representing fonts composed of characters that can be built using character elements that are common to a number of members of the font. Further advantages are obtained if the character elements can additionally be built from lower-level character elements that are common to a number of the character elements. Thus, the method can additionally be used to generate compact data sets representing fonts composed of alphabetic, numeric, cuneiform characters, symbols, pictorial characters, hieroglyphs and other structured characters. However, representing fonts composed of kanji characters particularly benefits from the present invention.

Figure 3B:
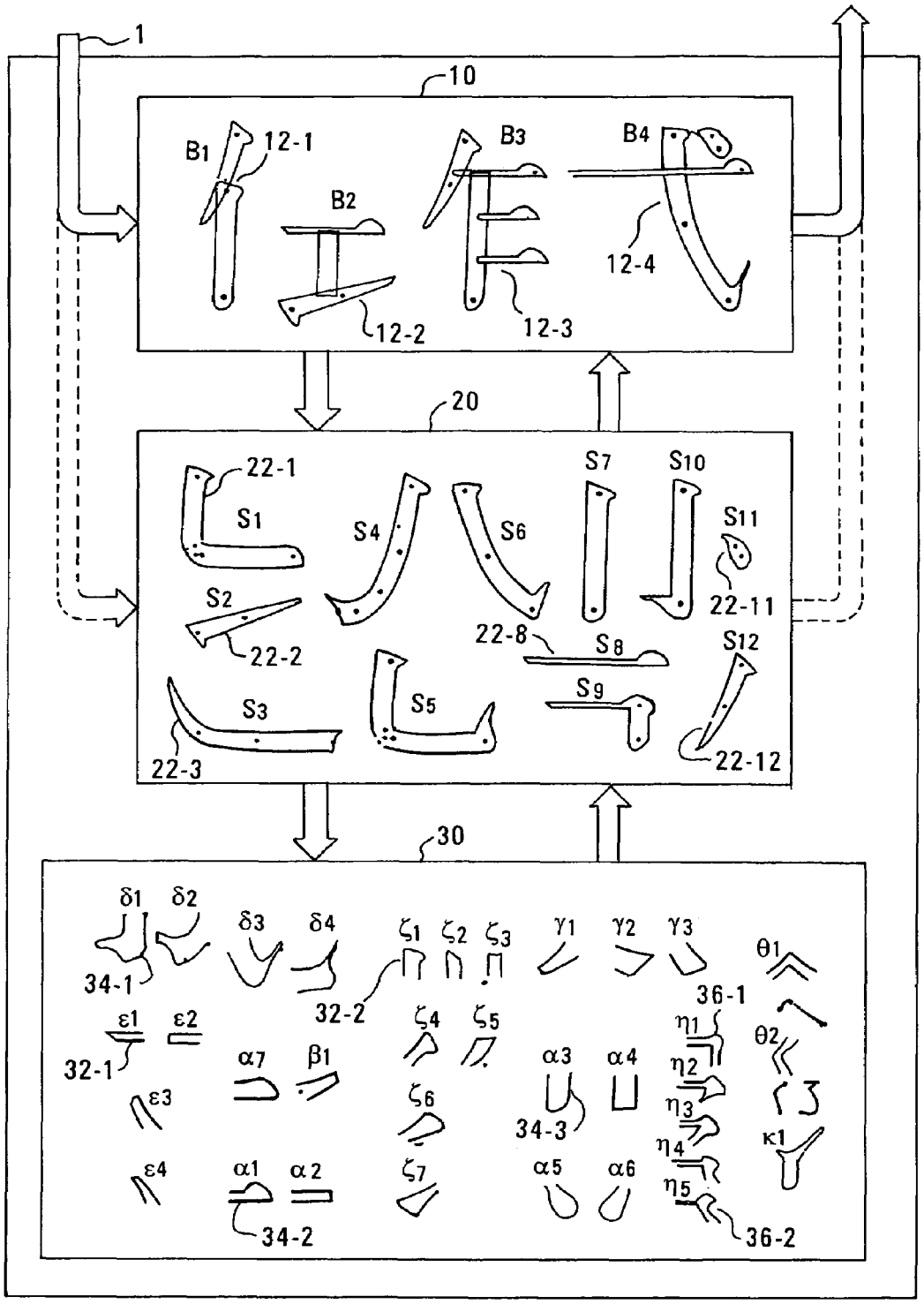
FIG. 3B illustrates the hierarchical structure of the character element generation functions used for generating the kanji character shown in FIG. 3A.

At the character level, if the character data 1 shown in FIG. 3B defines the group composed of the character code Lc and the argument $V_i$, each character element generation function $fk_j$ is selected from the library of character element generation functions stored in the storage device 59 in accordance with the character code Lc. At the character element level, if the character data 1 define the group composed of the character element code $Cc_i$ and the argument $V_i$, each lower, level character generation function $fk_j$ is selected from the library of lower-level character generation functions stored in the storage device 59 in accordance with the character element code $Cc_i$. The character element generation function $fk_j$ generates the value of the character element generation function in response to the argument $V_j$ as the shape data of the lower-level character element. Alternatively, the group composed of the character element generation functions $fk_j$ and the arguments $V_j$ are expanded to the group of the character element generation functions and the arguments of the next lower level to generate the shape data for the character.

In the above-mentioned hierarchical structure, the highest level, Level 0, of a kanji character is the kanji itself depicted at 41 and 42 in FIG. 3A. Level 1, indicated at 10 in FIG. 3B, includes the radical functions $B_u$ (u=1, 2, 3, . . . ) that generate the shapes 12-1, 12-2, 12-3, 12-4 of the radicals from which the kanji 41 and 42 are built. Level 2, indicated at 20, includes the stroke functions $S_v$ (v=1, 2, 3, . . . ) that generate the shapes 22-1, 22-2, 22-3, 22-11, 22-12 of the strokes from which the radicals are built. Level 3, indicated at 30, includes the stroke-beginning functions $Ss_w$ (w=1, 2, 3, . . . ) that generate the shapes 32-1, 32-2, . . . of the stroke beginnings from which the strokes are built, the stroke-end functions $Sf_w$ (w=1, 2, 3, . . . ) that generate the shapes 34-1, 34-2, . . . of the stroke ends from which the strokes are built, and the stroke-line functions $Sm_w$ (w=1, 2, 3, . . . ) that generate the shapes 36-1, 36-2, . . . of the stroke lines from which the strokes are built. The radical functions, stroke functions, stroke-beginning, stroke-end, and stroke-line functions are all character element generation functions $V_i$ of their respective levels. The processor automatically calculates the values of the character element generation functions in response to the respective arguments $V_i$.

When the character element code $Cc_i$ specifies the radical function $B_u$ of level 1, the argument of $B_u$ is the skeleton point data $V_i$. Note that $V_i$ need not be externally input and specified, but can be defined by the character code and the character element generation function. In addition, the character element generation function and its arguments can be determined from the character code and the environment variable specifying, for example, the size of the corresponding character.

Alternatively, the character element generation function can be assigned to the skeleton of the skeleton character corresponding to the character code.

An example of creating a character element using the process just described will be described next with reference to FIGS. 4A–4F. In this example, the character element is a vertical brush stroke of a kanji character. However, the same process can be used to build character elements at any level in the character element hierarchy.

Figure 4A:
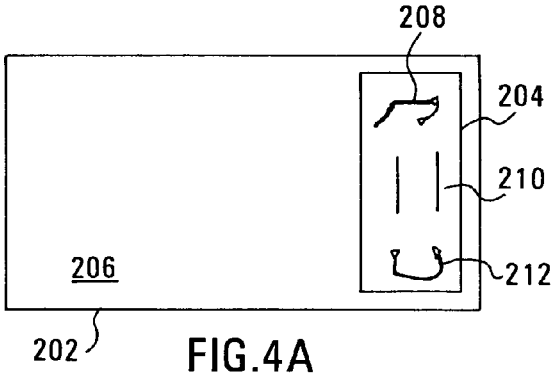
FIGS. 4A–4F illustrate a process by which a character element is created from existing lower-level character elements.

FIG. 4A shows the screen 202 of the display device 56 (FIG. 2). The screen is divided into the pallette display area 204 and the work area 206. The pallette display area displays a selection of lower-level character elements from which the character element can be built. In this example, the desired character element is a vertical line and is composed of the following lower-level character elements: a stroke beginning, a stroke line and a stroke end. The character is preferably designed in the same way in which it would be written. In other words, the character is designed in the order of stroke beginning, stroke line and stroke end.

The pallette display area displays a number of different stroke-beginning character elements, stroke-line character elements and stroke-end character elements, each generated by a different stroke-beginning function, stroke-line function and stroke-end function, respectively. To simplify the Figure, only one stroke-beginning character element 208, one stroke-line character element 210 and one stroke-end character element 212 are shown displayed in the pallette display area.

The lower-level character elements displayed in the pallette display area 204 may vary dynamically depending on the character element being built, the current portion of the character element being designed, and the typeface of the character. Moreover, the user may use the input device 60 to enter the character element code of an undisplayed lower-level character element to cause that character element to be displayed in the pallette display area. Alternatively, the user may select a position in the work area using the input device, and enter the character element code of an undisplayed lower-level character element to cause that lower-level character element to be displayed at the selected location in the work area.

To build the desired character element, the user selects one of the stroke-beginning character elements displayed in the pallette display area 204 and displays the selected stroke-beginning character element 208 in the work area 206, as shown in FIG. 3B. This may be done, for example, using the mouse or other suitable pointing device connected to the input device 60 to move the selected stroke-beginning character element from the pallette display area to the desired location in the work area.

Figure 4D:
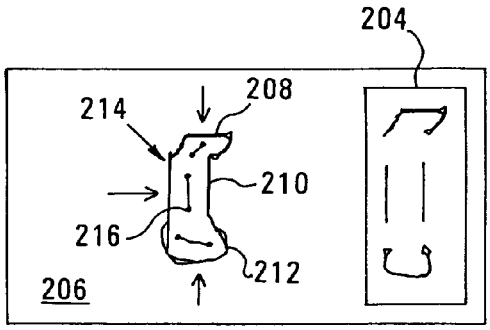
Figure 4B:
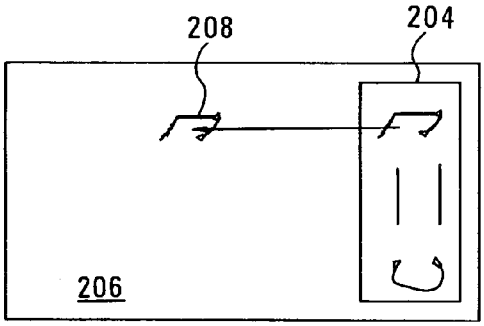
Figure 4E:
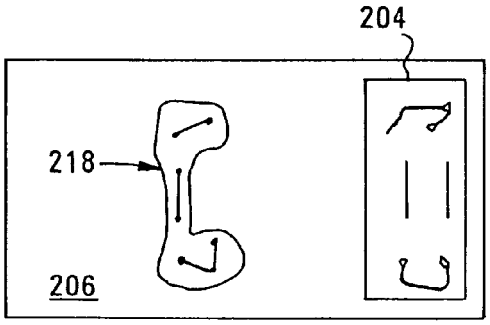
Figure 4C:
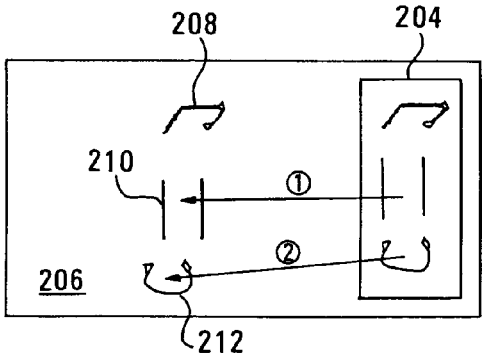

FIG. 4C shows the stroke-line character element 210 and the stroke-end character 212 element sequentially selected from the lower-level character elements displayed in the pallette display area 204 and placed in the work area 206 in desired locations relative to the stroke-beginning character element 208.

The user then uses the input device 60 to adjust the relative positions of the lower-level character elements 208, 212, and 212 constituting the desired character element 214 to generate the desired character element shape, as shown in FIG. 4D. Dragging a lower-level character element to change its position preferably moves the lower-level character element conformally, so that the shape of the character element is preserved. The skeleton points of the lower-level character elements are indicated by dots such as the dot 216.

The user may modify the shape of one or more of the lower-level character elements to enable the lower level character elements to fit together to provide the desired character element shape. The above-described fine tuning of position and shape optimizes the aesthetic appearance of the character element. Modifications to the shape of the character may be made in any one of the following ways:

entering or selecting a new environment variable, moving, adding or deleting points on the outline of the character element, or moving, adding or deleting one or more skeleton points of the character element.

FIG. 4E shows the character 218, which is the result of changing the environment variable and moving the skeleton points on the shape of the vertical stroke shown in FIG. 4D.

Symbolic "handles" on the lower-level character elements, on the points on the outline of the character element and on the skeleton points may be displayed in the work area 206 to facilitate these position and shape adjustments.

Figure 4F:
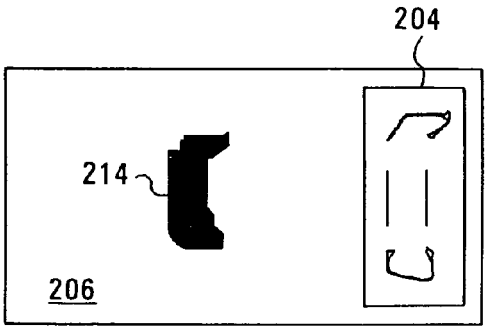

Finally, if the desired character element is a filled character element, the shape of the character element 214 may be filled as shown in FIG. 4F.

When the user is satisfied with the created character element, the user can then enter a command using the input device 60 to cause the processor 54 to save the character element. The processor then stores data representing the character element code, skeleton point data showing the relative positions of the lower-level character elements from which the character element is built, and the index of the character element generation function of each of the lower-level character elements. These data are linked to one another and are stored in the storage device 59. The index can be the same as the character element code when only one font is available, but is different when the character element is available in different fonts. If the process of generating the stroke function just described is the last step of the process of creating the compact data set representing the character, the processing device 54 matches the character code input separately to the group of character element generation functions defining the character elements from which the character is built and registers them in the font.

The character element generation function for generating the shape of each character element uses an improved spline function in the present embodiment. Spline functions require a relatively small number of shape-defining points to define the shape of the character element. Moreover, spline functions generate curves that connect the defining points without spurious curvature changes. Therefore, using a spline function as the character element generation function has the advantages of simplicity, ease of modification, and a short calculation time. Conventional spline functions can be used to generate the shapes of the character elements in the method according to the invention. Practical embodiments of the invention use a method disclosed by Naoi et al. in Examined Japanese Patent Publication No. 2-527187 in connection with compressing pattern data to generate the character element generation functions.

An example in which the level hierarchy had three levels below the highest level was described above. However, the number of levels is not limited to three, and more or fewer levels can be used. Practical embodiments using three-level systems have worked well. An embodiment of the invention will be described in more detail below.

Figure 5:
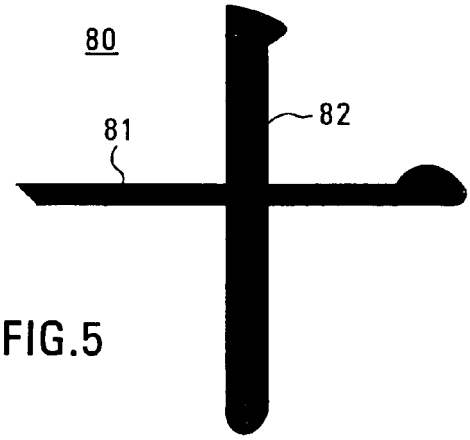
FIG. 5 shows the kanji character "ju" in the form in which it is displayed.
Figure 6:
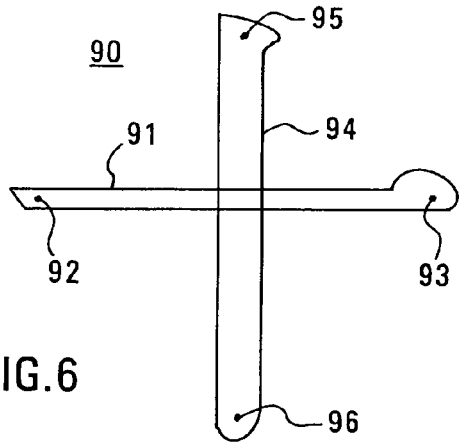
FIG. 6 shows the shapes of the character elements constituting the kanji character "ju" shown in FIG. 5.
Figure 7:
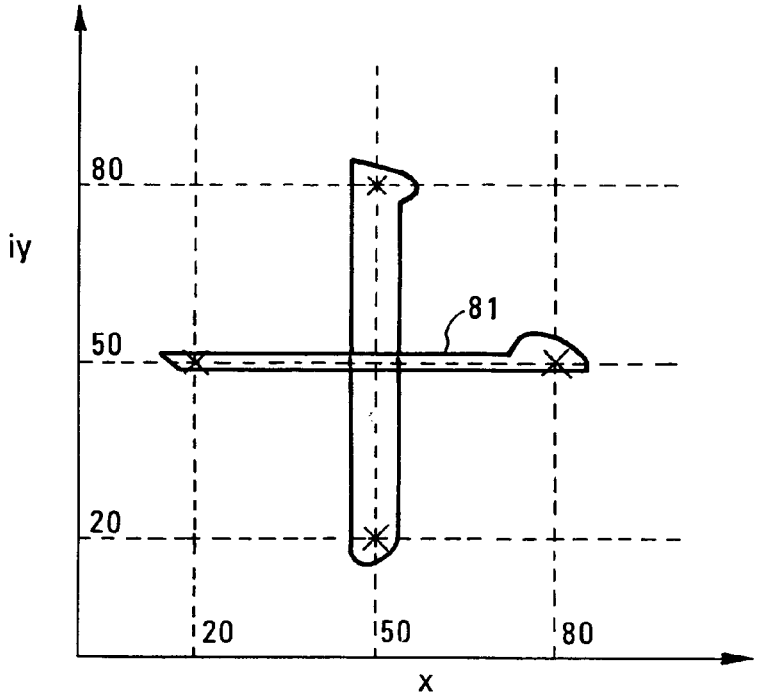
FIG. 7 illustrates the coordinate system on which the skeleton point data are based.

Representation of the character 80 by the invention will now be described with reference to FIGS. 5, 6 and 7. FIG. 5 shows the final character 80 as it would be displayed on the screen of the display device 56 of the workstation 50 shown in FIG. 2. The character is composed of the horizontal character element 81 and the vertical character element 82 that intersects the horizontal character element. FIG. 6 shows the shape 90 of the character 80 and the shapes of the character elements 81 and 82. Since the character element 81 is basically a horizontal straight line, the skeleton of the character element 81 can be specified by two points, the starting point 92 and the end point 93. The skeleton point data of these points are p and q, respectively. The character element generation function f that generates the shape of the character element 81 is supplied with the arguments p and q and generates the shape of the character element 81 as a closed curve 91 from the values f(p, q) of the function.

Similarly, the closed curve 94 representing the shape of the character element 82 is generated by the function values g(r,s) of the character element generation function g that generates the shape of the character element 82 with the arguments of the skeleton point data r and s of the starting point 95 and the end point 96. The character 80 is completed by filling the area enclosed by the curves 91, 94 representing the shapes of the character elements 81 and 82.

Therefore, the character 80 is specified and generated by data representing four skeleton points and the data representing two character element generation functions. When the index of the character element generation function is sufficient to specify the character element generation function without any modification parameters, the character element generation function may be specified by its index to reduce the number of data.

Comparing the example shown in FIG. 6 with the same character generated using a conventional outline font depicted in FIG. 1, it can be seen that substantially fewer data are required to represent the character when the character is represented using the method according to the invention than when the character is represented using an outline font. The reduction in data is even more significant when, instead of a single character, a font composed of characters that share common character elements is represented. For example, a character set composed of 1400 Japanese characters in three typefaces can be represented using about 130 kBytes (97 bytes/character) using the invention, whereas to represent a similar number of characters in a single typeface would require about 1.5 MBytes (1125 bytes/character) using a Truetype™ font and about 950 kBytes (695 bytes/-character) using a Postscript™ Type I font.

An example of using the stroke function $S_8$ that generates the shape 22-8 shown in FIG. 3B to generate the horizontal character element 81 will be described next.

The character element code of the character element 81 specifies character element generation function and the skeleton point data p, q collectively used for generating the character element 81. The skeleton point data define locations in the coordinate plane (x, iy) of an orthogonal coordinate system having a real axis x and an imaginary axis iy defined in the display screen as shown in FIG. 7. In this, i is the square root of −1. Many useful program modules are available that use such a coordinate system to manipulate plane geometry. The character element code additionally specifies the index $a_1$ of the stroke function $S_8$. The index $a_1$ specifies a memory location or the address of a register where the data of the stroke function $S_8$ are stored.

In this example, the character element data specified by the character element code of the character element 81 for processing by the processing device 54 are ($a_1$, 20, 50; 80, 50). In this data representation, the first two numbers (20 and 50) respectively represent the x coordinate and they coordinate of p, and the last two numbers (80 and 50) respectively represent the x coordinate and they coordinate of q. In other words, p=20+50i and q=80+50i.

The processing device 54 additionally interprets the character element data as specifying the stroke-beginning function $\epsilon$1 that generates the shape 32-1 and the stroke-end function $\alpha$1 that generates the shape 34-2, both shown in FIG. 3B. The stroke-beginning and stroke-end functions are stored in the storage device 59 and are called by the processing device 54.

The data specifying the stroke-beginning function is ($\epsilon_1$ p q $\theta$), and the data specifying the stroke-end function is ($\alpha$, p q), where $\theta$ is a modification parameter that defines the angle of the pen at the beginning of the stroke. Generally, a default value may be assigned to the angle $\theta$, but different values of the angle $\theta$ may be used.

The processing device 54 accesses a linking table that parses the character element data to obtain the data defining the character elements from which the character is built. Such tables are provided for all but the lowest-level character elements and, in response to the character element code of a higher-level character element, provide calls to memory locations where are stored the character element generation functions and skeleton point data of the lower-level character elements from which the higher-level character element is built. Each higher-level character element generation function arranges its lower-level character elements in positions defined by the skeleton point data corresponding to the higher-level character element generation function. Moreover, in a set of skeleton point data, the skeletons constituting the skeleton character may also be used as character element codes to identify the character element generation function.

For example, processor 54 receives the character code and accesses the corresponding entry in the table for level 0. The table entry for the character code specifies a level 0 character element generation function code and corresponding skeleton point data. The character element generation function code defines the level 1 character element generation function codes from which the character is built. The level 0 skeleton point data define the size, locations and orientations of the level 1 character elements in the character. The processor then accesses the entry for each level 1 character element generation function code in the table for level 1. The table entry specifies level 1 character element generation function codes and respective skeleton point data. The level 1 character element generation function codes specify character element generation function codes for the level 2 character elements from which the level 1 character element is built. The level 1 skeleton point data defines the size, locations and orientations of the level 2 character elements in the respective level 1 character.

The processor 54 generates the level 2 character elements using the level 2 character element generation functions with the level 2 skeleton point data as arguments. The processor next generates the level 1 character elements using the level 1 character element generation functions with the level 1 skeleton point data as arguments to arrange the level 2 character elements to form each character element. The processor finally generates the character using the level 0 character element generation function with the level 0 skeleton point data as arguments to arrange the level 1 character elements to form the character.

Figure 8A:
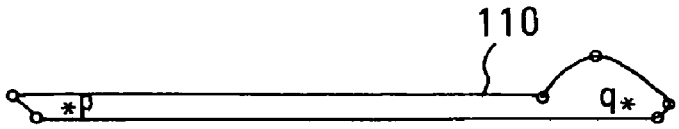
FIGS. 8A–8D shows how character elements are generated and may be modified by specifying modifying parameters.

The processing device 54 calculates and outputs the values of the stroke-beginning function, the stroke-line function and the stroke-end function in accordance with elements of the environment variable, such as the aspect ratio and the typeface. FIG. 8A shows the shape 110 that results from the process just described. The positions of the skeleton points p and q specified by the argument data are indicated by asterisks (*) and the data points generated by the spline function are indicated by circles (o).

Figure 8B:
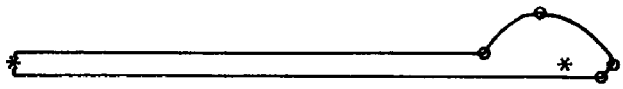
Figure 8C:
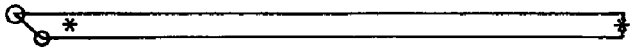
Figure 8D:
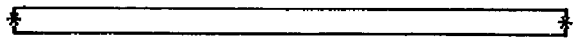

In an example of typical processing where a horizontal line that has a uniform width is vertically cut only at the ends, additional data that specify modification parameters can be included. For example, FIG. 8B shows the character element shown in FIG. 8A modified to have a uniform, vertical profile at the stroke beginning. This line is specified by ($a_1$ 20 50 80 50: head 1). FIG. 8C shows the character element shown in FIG. 8A modified to have a uniform, vertical profile at the stroke end. This line is specified by ($a_1$ 20 50 80 50: tail 1). FIG. 8D shows the character element shown in FIG. 8A modified to have uniform, vertical profiles at both the stroke beginning and the stroke end. This line is specified by ($a_1$ 20 50 80 50: head 1: tail 1). Thus, the character element can be modified by adding the data item "head 1," or "tail 1," or both "head 1" and "tail 1" to the character element data. Since the modification parameters are specified by data composed of a maximum of several bits, the data that specify the modification parameters have a negligible effect on the number of data required to specify the character element.

Figure 9A:
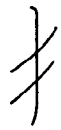
FIGS. 9A–9D illustrate the parameters curvature, roundness and thickness.
Figure 9B:
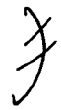
Figure 9C:
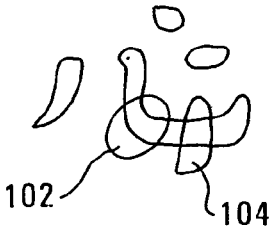
Figure 9D:
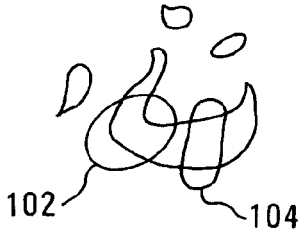

In addition modifying the stroke beginning and stroke ending of the character element, the modification parameters adjust such quantities as the curvature, roundness and thickness of the character element. These parameters are factors that help define the appearance of the character element and are illustrated in FIGS. 9A–9D. FIGS. 9A and 9B show the same character in two different typefaces. The vertical stroke of the character shown in FIG. 9A has a smaller curvature than the corresponding stroke of the character shown in FIG. 9B. FIGS. 9C and 9D show another character in two different typefaces. The portion 102 of the character shown in FIG. 9C has a smaller roundness than the corresponding portion of the character shown in FIG. 9D. The portion 104 of the character shown in FIG. 9C has a smaller thickness than the corresponding portion of the character shown in FIG. 9D.

Figure 10:
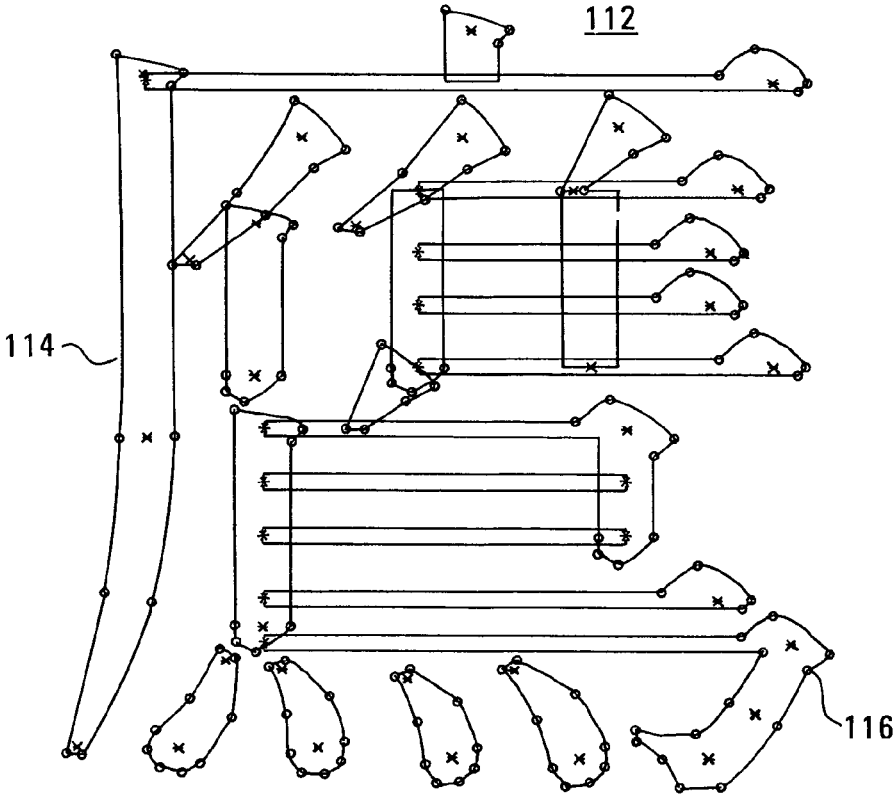
FIG. 10 is an example of the shape of a character generated by one embodiment of the invention.

FIG. 10 shows the kanji character "TAKA" 112 in which the positions specified by the skeleton point data are indicated by asterisks and the data points traced by the spline functions are indicated by circles, as in FIG. 8A. It should be noted that only the character elements that are curved, such as the character element 114, or bent, such as the character element 116, are specified by more than two skeleton point data.

The typeface in which the characters are displayed can be changed simply by imposting the element K of the environment variable that specifies a different typeface on the existing skeleton point data r, s and the existing character element generation functions. Moreover, the line-width used to form the characters can be changed simply by imposing an element of the environment variable that specifies a different line width on the existing skeleton point data r, s and the existing character element generation functions. If the typeface and the aspect ratio are initially specified as elements of the environment variable, only the character code and size of each character need be specified either by the font designer when the characters are created, or by character data when the character is displayed. This further reduces the amount of data that need be transmitted to represent a set of characters.

The skeleton character, environment variables, and character element generation functions are each stored separately. The processing device 54 calls these parameters as needed to generate the characters.

The number of skeleton point data differs for each character element, but the number of skeleton point data should be minimized as shown above. The number of skeleton point data required to specify the strokes of Kanji characters is five or fewer per character, with the average number being three per character.

If the skeleton point data are regarded the code that defines the character element, the character element can be determined from the skeleton point data. Therefore, the character element generation function can be determined from the skeleton character and the shape of the character can be generated. For example, a typical method for pattern recognition that can be used with the skeleton point data as the pattern is described by Takahiko Kawatani in *Handwritten Numeral Recognition by Training a Distance Function*, TRANS. OF THE INSTITUTE OF ELECTRONIC, INFORMATION AND COMMUNICATION ENGINEERS (D-II), J76-D-II, 9, pp. 1851–59 (1993). Since irregularities in the skeleton point data belonging to a category are small compared to handwritten characters, the invention enables the recognition engine used in such character recognition to be made simpler.

Figure 11:
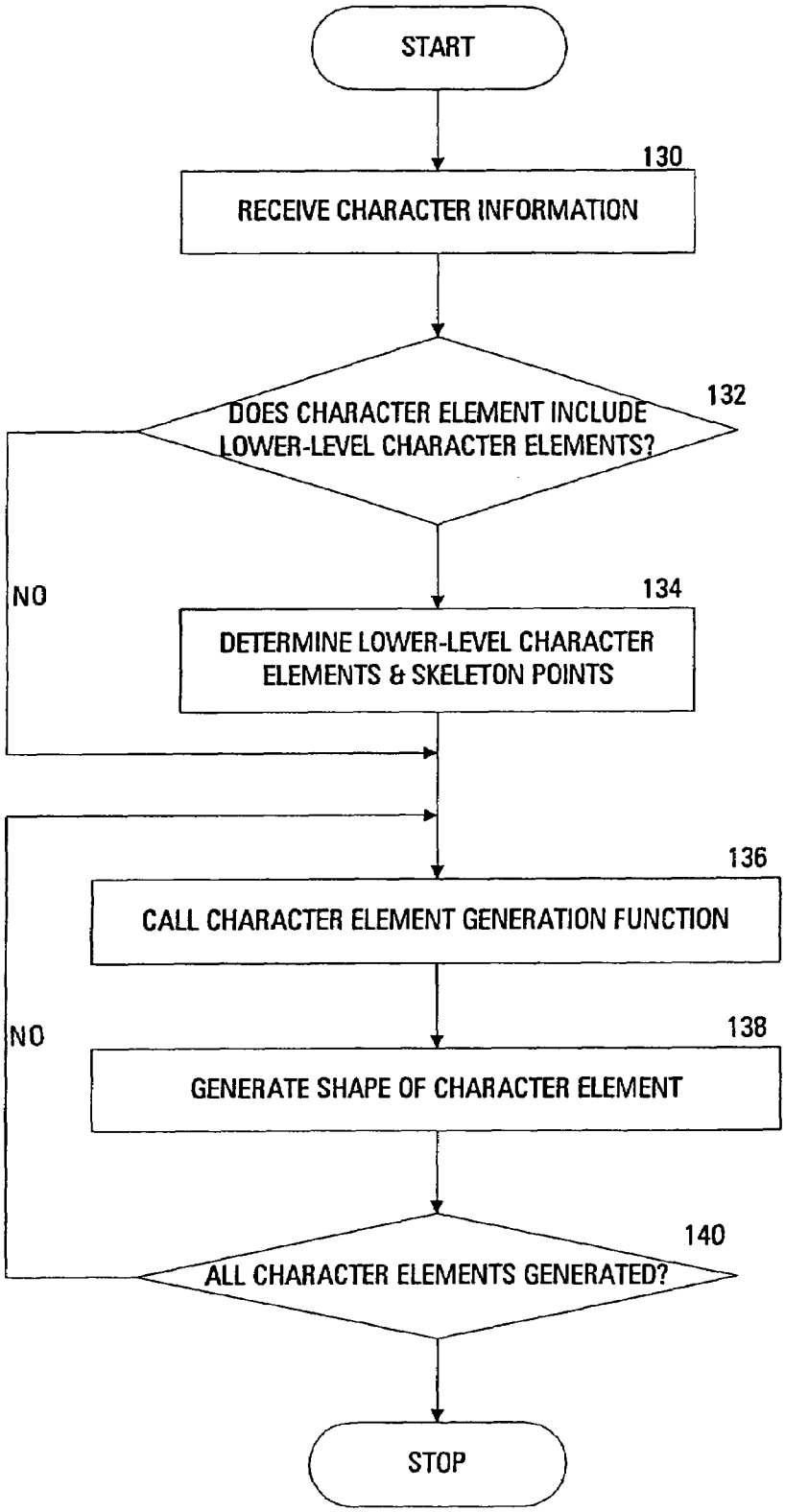
FIG. 11 is a flow chart that shows the process steps that occur when a program executing the method of the invention instructs a computer.

FIG. 11 shows the process steps for instructing the computer by a program stored in a storage medium provided in the processing device 54, storage device 59, or editor 58 to implement the method of the present invention on a computer, such as the microprocessor of the workstation shown in FIG. 2.

At step 130, the character element code that specifies the character element generation function and the corresponding skeleton point data are received.

At step 132, a test is performed to determine whether the character element defined by the received character element code includes lower-level character elements. For example, if the received character element code defines a stroke, the test would determine whether the stroke is defined, at least partially, by a stroke-beginning function, a stroke-end function and a stroke-line function. If the test result is NO, execution advances to step 136, which will be described below. If the test result is YES, execution advances to step 134.

At step 134, the character element codes of the lower-level character elements are determined from the character element code and the skeleton point data of the character element.

At step 136, a character element generation function is called from the storage device. If step 134 has been performed, the lower-level character element generation functions corresponding to the lower-level character element codes determined at step 134 are called. Otherwise, the character element generation function corresponding to the character element code of the character element is called.

At step 138, the character element generation function operates in response to the skeleton point data to generate the shape of the character element.

At step 140, a test is performed to determine whether all the character elements have been generated.

If the test result is NO, execution returns to step 136 so that more character elements can be generated. If the test result is YES, processing ends.

In the character generation method according to the invention, affine transformations can be applied to the skeleton point data entered into the character element generation function or to the skeleton characters to effect a deformation of the character. Such transformations can scale, rotate or tilt the character. Therefore, many typefaces can be easily obtained without increasing the number of data, and the sizes of the characters can easily be changed as well. In addition, translation of the characters is simple.

Similar effects can be obtained by applying the above transforms only to the skeleton point data.

An apparatus that generates signals in response to which characters represented by compact data sets according to the invention can be displayed will now be described with reference to FIGS. 12A–12C. The apparatus may be constructed using discrete components, large-scale or small-scale integrated circuits or application-specific integrated circuits. Alternatively, the apparatus may be realized by suitably programming the processing device 54 or some other computer or digital signal processor.

Figure 12A:
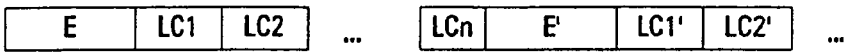
FIGS. 12A and 12B show the format of input data when character codes and character element codes, respectively, are received.

FIG. 12A shows the format of the input data when character codes are received. The environment variable E relating to a first font is followed by the character codes LC1, LC2, . . . , LCn of the characters in that font. The environment variable E' relating to a second font is then followed by the character codes LC 1', LC2', . . . , LCn' of the characters in that font. Multiple environment variables and their respective character codes may follow.

Figure 12B:
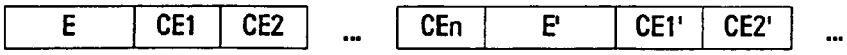

FIG. 12B shows the format of the input data when character element codes are received. The format is the same as that shown in FIG. 12A, except that character element codes follow the environment variable instead of character codes.

Figure 12C:
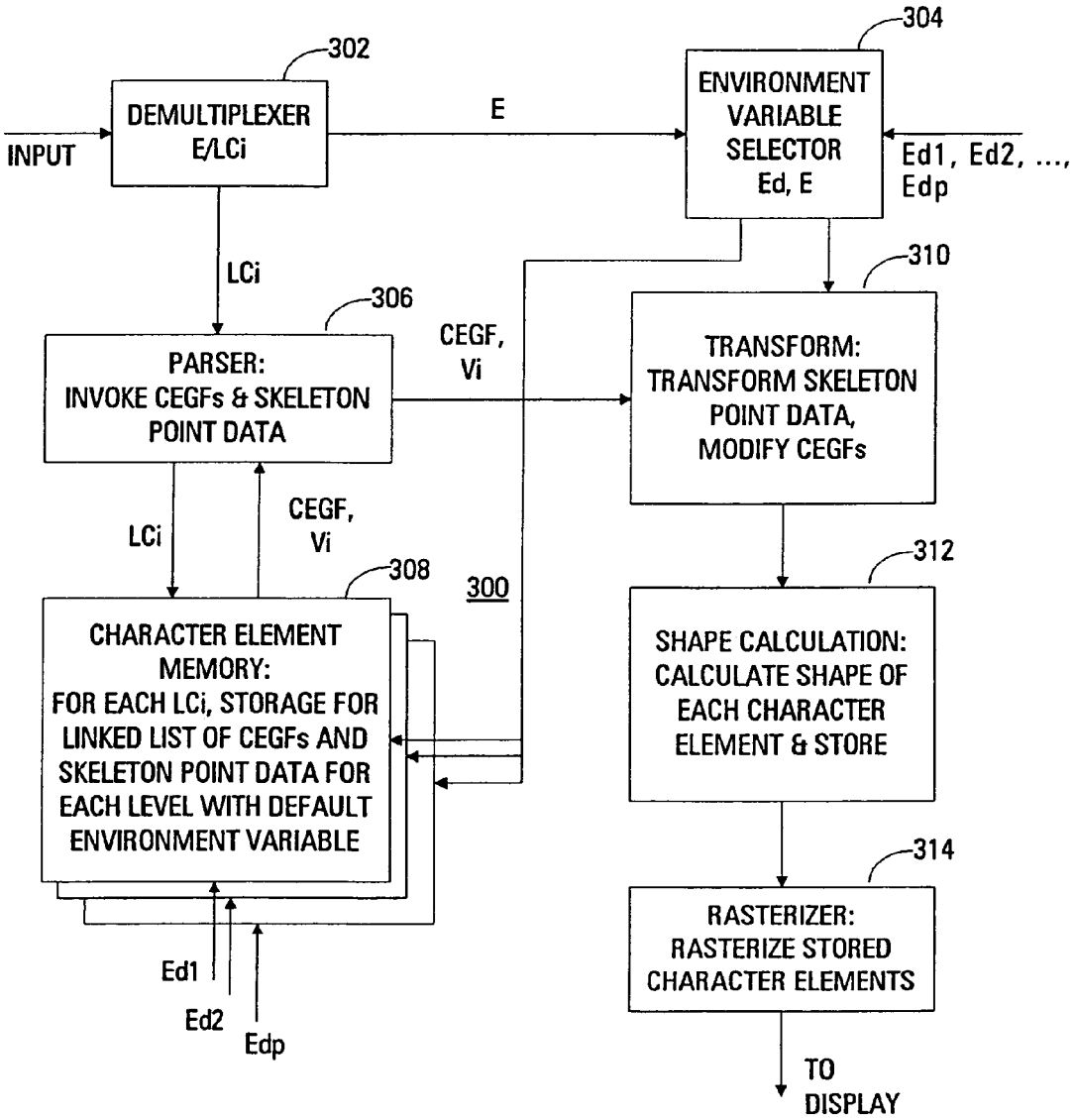
FIG. 12C is a block diagram of an apparatus that generates signals in response to which characters represented by compact data sets according to the invention can be displayed.

In the apparatus 300 shown in FIG. 12C, the demultiplexer 302 receives an input in either of the formats shown in FIGS. 12A and 12B. In this example, the input is character-level data in the format shown in FIG. 12A. The demultiplexer separates the environment variables E, E', etc. from the character codes LCi, LCi', etc. In this example, operation of the apparatus to process only the environment variable E and the character codes LCi will be described. The apparatus applies the same processing to the other environment variables and their respective character codes. The demultiplexer forwards the environment variables to the environment variable selector 304 and forwards the character codes to the parser 306.

The character element memory 308, which typically forms part of the memory device 59, stores linked lists of character element generation functions, skeleton point data and default environment variables Ed. Character element generation functions and corresponding skeleton point data are stored for each level of character elements constituting the character. These lists are linked to the character code LCi.

The parser 306 invokes the character element generation functions and their respective skeleton point data and the default environment variable Ed by feeding the character code LCi to the character element memory 308. In response to the character code and an indication of the default environment variable, the character element memory returns a complete set of the character element generation functions and corresponding skeleton point data for the character element from which the character is built.

The parser 306 feeds the set of character element generation functions and corresponding skeleton point data for each character element constituting the character to the transform module 310. The transform module 310 additionally receives instructions from the environment variable selector 304.

The environment variable selector 304 receives the environment variable E extracted from the input data by the demultiplexer 302 and additionally receives information indicating the default environment variable Ed stored in the character element memory 308. The environment variable selector compares the environment variable E extracted from the input data with the default environment variable E. When the environment variable selector finds a complete match between the environment variable E extracted from the input data and the information indicating the default environment variable Ed stored in the character element memory 308, the environment variable selector sends an instruction to the character element memory that causes the latter to read out the character element generation functions and skeleton point data corresponding to the default environment variable. Moreover, when a complete match is found, the environment variable selector instructs the transform module 310 that the transform module is not required to apply a transform to the skeleton point data read from the character element memory.

Typically, several default environment variables Ed1, Ed2, . . . Edp, are stored in pages of the character element memory 308, as in the example shown in FIG. 12C. This provides more alternative default typefaces, such as Mincho, Gothic, etc. When a complete match is found between the environment variable E and any one of the default environment variables, the environment variable selector instructs the character element memory to feed the character element generation functions and skeleton point data corresponding to the default environment variable for which the match was found.

When the environment variable selector 304 finds a partial match between the environment variable E extracted from the input data and one of the default environment variables Ed1 . . . Edp, the environment variable selector instructs the character element memory 308 to read out the character element generation functions and skeleton point data corresponding to the default environment variable that most closely matches the environment variable E and additionally instructs the transform module 310 to apply a suitable transform to the skeleton point data. The environment variable selector may additionally or alternatively instruct the transform module to modify the character element generation functions. An example of a partial match is that the environment variable E indicates a font that is similar but not identical to the font represented by one of the default environment variables stored in the character element memory 308.

In response to the above-mentioned instructions generated by the environment variable selector 304, the transform module 310 applies conformal or affine transforms to the skeleton point data. The transform module may additionally or alternatively apply a spatial transform to change the positions of the skeleton point data. Finally, the transform module 310 may modify the character element generation functions in response to an instruction issued by the environment variable selector 304. The transform module feeds the skeleton point data and the modified character element generation to the shape calculation module 312.

The shape calculation module 312 calculates the shape of each character for which skeleton point data and character element generation functions are received from the transform module 310. The skeleton point data may have been transformed and the character element generation functions may have been modified by the transform module as described above.

For each level of the hierarchy, the shape calculation module 312 calculates the shape of each character element using the appropriate character element generation function with the skeleton point data as arguments for the function. The shape calculation module stores data representing the successive character shapes in a suitable memory in an arrangement that allows the arrangement of the characters on each page of the document to be emulated.

The shape calculation module 312 reads out data representing the stored character shapes in units of pages, portions of pages, or multiple pages, depending on what portion of the document is to be displayed, and feeds the resulting data to the rasterizer 314. The rasterizer scans the data received from the shape calculation module to generate a bitmap signal suitable for feeding to a display. The bitmap signal represents in bitmap form the arrangement of character shapes on a page represented by the data stored by the shape calculation module 312. The display displays the characters in response to the bitmap signal.

An example of an apparatus that represents characters using compact data sets according to the invention will now be described with reference to FIGS. 13A and 13B. The apparatus may be constructed using discrete components, large-scale or small-scale integrated circuits or application-specific integrated circuits. Alternatively, the apparatus may be realized by suitable programming the processing device 54 or some other computer or digital signal processor. The apparatus operates in conjunction with the display device 56 shown in FIG. 2. The preferred layout of the screen of the display device is shown in FIGS. 4A–4F.

Sections of the apparatus not shown establish the basic layout of the screen 202 of the display device 56 shown in FIG. 4A. The apparatus shown in FIG. 13A performs the processing illustrated in FIGS. 4A–4D. The apparatus shown in FIG. 13B performs the processing illustrated in FIG. 4E. The character is filled as shown in FIG. 4F by an appropriate setting of the rasterizer that forms part of the apparatus.

Figure 13A:
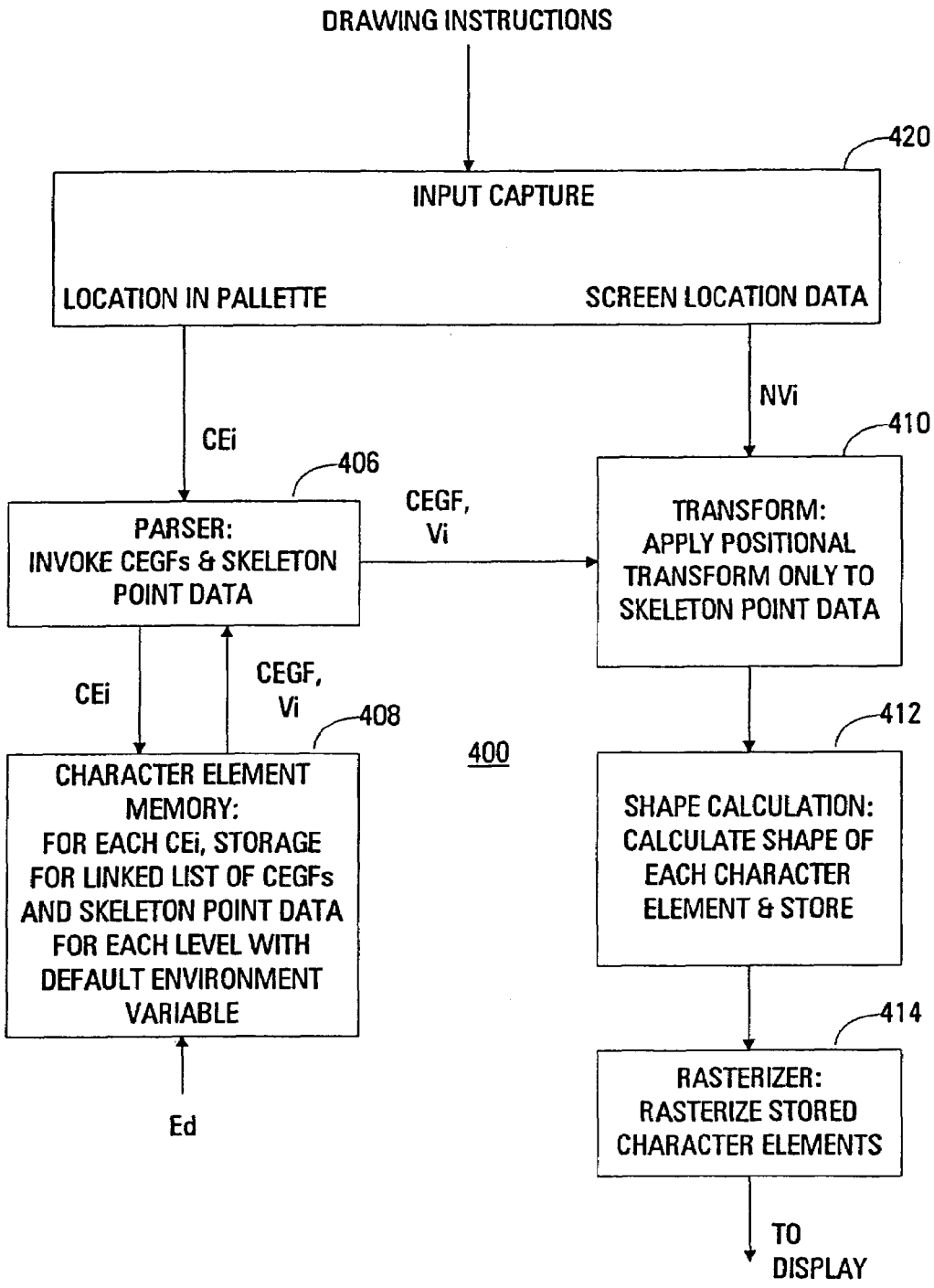
FIGS. 13A and 13B are block diagrams of examples of apparatus that represent characters using compact data sets according to the invention.

Elements of the apparatus 400 shown in FIG. 13A that are similar to elements of the apparatus 300 shown in FIG. 12C are indicated using the same reference numerals with 100 added.

In the character element representation operation illustrated in FIGS. 4A–4F, character elements selected from the pallette of character elements are arranged on the screen 202 to form a character or a higher-level character element. The character element is displayed in the work area 206 as it is created in response to the character element generation functions and corresponding skeleton point data input by the user. Consequently, what is displayed in the work area 206 is an accurate representation of how the character will appear when used to display a document. The apparatus shown in FIG. 13A performs this display operation.

In the apparatus 400 shown in FIG. 13A, the user enters character creation instructions using a mouse or keyboard connected to the input device 60. These instructions are captured by the input capture module 420. These instructions have two main components, namely, the user's selection of a lower-level character element from the pallette 204 shown in FIG. 4A, and the user's positioning of a skeleton point of the lower-level character element at a specific location in the work area 206 to form the character or higher-level character element, as shown in FIG. 4D. The user's selection of each character element causes the input capture module to capture a corresponding character element CEi. The user's positioning of the skeleton point of the character element in the work area causes the input capture module to capture corresponding skeleton point data NVi.

The apparatus 400 includes a parser 406, transform module 410, shape calculation module 412 and rasterizer 414 that are basically similar to the parser 306, transform module 310, shape calculation module 312 and rasterizer 314, respectively, described above with reference to FIG. 12C. The apparatus additionally reads data from the character element memory 308 shown in FIG. 12C. The character element memory is shown with a single page in FIGS. 13A and 13B to simplify the drawings.

Like the parser 306 when the input shown in FIG. 12C is an input of character element codes CEi, the parser 406 parses each character element code CEi generated by the input capture module 420 to invoke lower-level character element generation functions and corresponding skeleton point data. The lower-level character element generation functions and corresponding skeleton point data are read from the character element memory 308 and are passed to the transform module 410. The input capture module also feeds the skeleton point data corresponding to each character element generation function to the transform module 410. The transform module 410 uses the skeleton point data NVi received from the input capture module to apply only a positional shift to the skeleton point data Vi read from the character element memory 408. This takes account of the user's positioning of the character element in the work area 206.

The shape calculation module 412 and the rasterizer 414 operate in response to the character element generation function and the positionally-transformed skeleton point data to generate a bitmap signal that represents the shape of the character or higher-level character element. This signal is applied to the work area 206 of the screen 202 to display the character or higher-level character element.

Figure 13B:
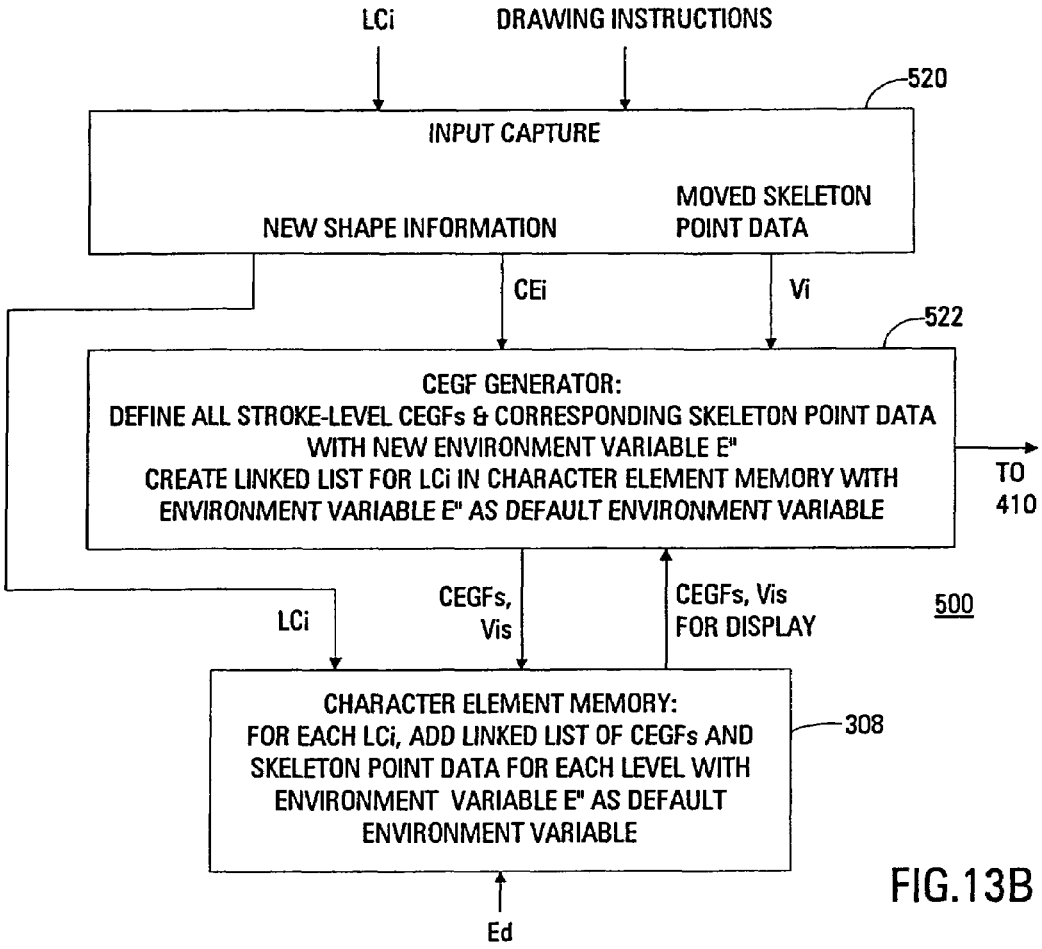

FIG. 13B shows the apparatus 500 that performs the processing when the user modifies the shape of the character, as shown in FIG. 4E. The apparatus is composed of the input capture module 520 and the CEGF generator 522, and stores data in and reads data from the character element memory 308. The apparatus additionally includes the transform module 410, the shape calculation module 412 and the rasterizer 414 of the apparatus 400 shown in FIG. 13A, although these modules have been omitted from the drawing.

The input capture module 520 captures the user's character creation instructions. In this case, the instructions include a character element code CEi input or selected by the user, point data indicating modifications to the shape of the character element and amended skeleton point data indicating changes in the positions of the skeleton points. The user may additionally input a new environment variable E". Alternatively, the processing device 54 may calculate the new environment variable E" from the form of the character the user has created on the screen. Absolute values are normalized in accordance with the dimensions of the work area 206. The data capture module forwards the captured data to the character element generation function generator 522. In response to these data and the environment variable E", the character element generation code generator generates, for each character code LCi, the new character element generation functions and their corresponding skeleton point data for each character element from which the character is built. The character element generation function generator packages the character element generation functions and their skeleton point data in a linked list and forwards the linked list to the character element memory for storage. Each linked list is linked to the character code LCi and the environment variable E".

The character element memory 308 forwards the new character element generation functions and their corresponding skeleton point data though the character element generation function generating module 522 for forwarding to the transform module 410 (not shown). As noted above, the transform module 410, shape calculation module 412 and rasterizer 414, none of which is shown, in response to the character element generation funcionts and their corresponding skeleton point data to generate a bitmap signal in response to which the newly-created character is displayed in the work area 206 as described above.

Figure 14:
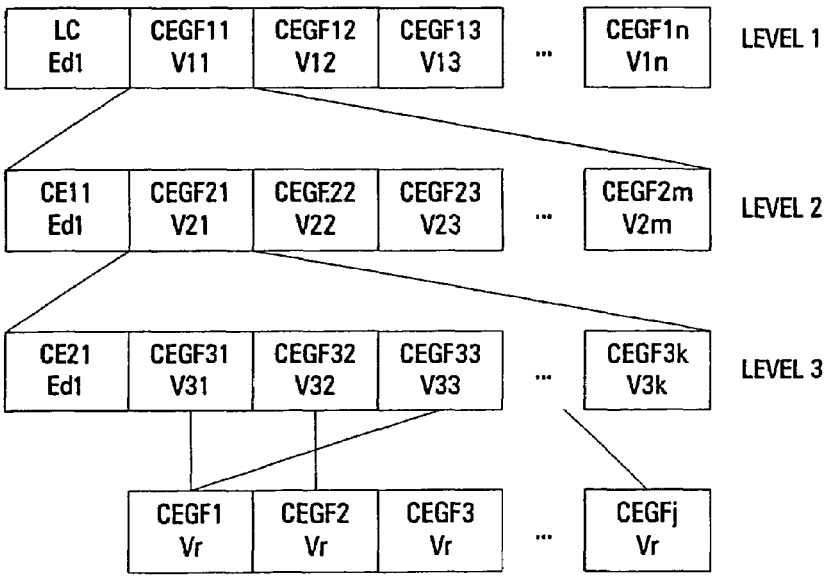
FIG. 14 shows an example of the structure of the linked lists used in the character element memory of the apparatus shown in FIGS. 12C, 13A and 13B.

An example of a linked list as used in the character element memory 308 is shown in FIG. 14. At level 1, the character code LC and data indicating an environment variable are stored, followed by a set of character element generation functions CEGF11-CEGF1*n* and their corresponding skeleton point data V11-V1*n*. The data indicating the environment variable may be a new environment variable or may be a pointer to one of the default environment variables Ed1, Ed2, . . . , Edp stored in the character element memory 308.

Each of the level 1 character element generation functions is in turn defined by a lower-level definition composed of character element generation functions and corresponding skeleton point data. For example, the level 1 character element generation function CEGF11 is defined by the level 2 character element code CE11, character element generation functions CEGF21-CEGF2*m* and corresponding skeleton point data V21-V2*m*.

Each of the level 2 character element generation functions CEGF21-CEGF2*m* may be defined by a lower-level definition composed of character element generation functions and corresponding skeleton point data, as is shown in level 3 for the level 2 character element generation function CEGF21. When a lower level exists, the character element generation functions and the skeleton point data are composed simply of addresses indicating the location in the character element memory where the lower-level data are stored. Some character element generation functions are shared among character elements and characters. This is achieved by several higher-level character element generation functions and skeleton point data pointing to the same lower-level address where such shared character element generation functions and skeleton point data are stored.

Although this disclosure describes illustrative embodiments of the invention in detail, it is to be understood that the invention is not limited to the precise embodiments described, and that various modifications may be practiced within the scope of the invention defined by the appended claims.

I claim:

1. A method for representing and/or displaying a kanji character at includes a character element, the method comprising:

receiving (a) a character element code that specifies the character element, and (b) skeleton point data that represent a position and a shape of a skeleton of the character element;

providing a character element generating function corresponding to the character element code;

generating a shape of the character element using the character element generating function with the skeleton point data as arguments therefor, and associating the character element code and the skeleton point data with a character code that specifies the character, the character element comprising no more than one stroke of the kanji character, and the position and shape of the skeleton of the character element being represented by no more than five skeleton point data.

2. A method for representing and/or displaying a kanji character that includes a character element, the method comprising:

receiving (a) a character element code that specifies the character element, and (b) skeleton point data that represent a position and a shape of a skeleton of the character element;

providing a character element generating function corresponding to the character element code;

generating a shape of the character element using the character element generating function with the skeleton point data as arguments therefor, the character element corresponding to no more than one stroke of the kanji character; and representing the position of the character element by no more than five skeleton point data.

3. A method for representing and/or displaying a kanji character that includes a stroke, the method comprising:

receiving a character element code specifying the stroke;

receiving skeleton point data representing a position and a shape of a skeleton of the stroke, the skeleton point data being received after the character element code has been received;

calculating a shape of the stroke using a character element generation function that corresponds to the character element code with the skeleton point data as arguments for the character element generation function; and defining the position and shape of the stroke by no more than five skeleton point data.

* * * * *